US006488723B2

(12) United States Patent
Nelson et al.

(10) Patent No.: US 6,488,723 B2
(45) Date of Patent: Dec. 3, 2002

(54) MOTOR FUEL ADDITIVE COMPOSITION AND METHOD FOR PREPARATION THEREOF

(76) Inventors: Alfred Richard Nelson, 5165 James St., Williamsburg, MI (US) 49690; Mark L. Nelson, 4875 DTC Blvd., Bldg. 2-103, Denver, CO (US) 80237; Otis L. Nelson, Jr., 2171 S. Lakeshore Dr., Lake Leelanau, MI (US) 49653

( * ) Notice: Subject to any disclaimer, the term of this patent is extended or adjusted under 35 U.S.C. 154(b) by 0 days.

(21) Appl. No.: 09/776,585

(22) Filed: Feb. 2, 2001

(65) Prior Publication Data

US 2002/0023383 A1 Feb. 28, 2002

Related U.S. Application Data

(63) Continuation-in-part of application No. 08/472,179, filed on Jun. 7, 1995, now abandoned, which is a continuation-in-part of application No. 08/198,503, filed on Feb. 18, 1994, now abandoned, which is a continuation-in-part of application No. PCT/US91/01332, filed on Mar. 5, 1991, which is a continuation-in-part of application No. 07/488,670, filed on Mar. 5, 1990, now abandoned.

(51) Int. Cl.[7] ..... C10L 1/18; C10L 1/22

(52) U.S. Cl. ..... 44/331; 44/347; 44/432; 44/433; 44/451

(58) Field of Search ..... 44/330, 331, 347, 44/432, 433, 434, 451

(56) References Cited

U.S. PATENT DOCUMENTS

| | | | | |
|---|---|---|---|---|
| 3,172,892 A | | 3/1965 | Le Suer et al. | |
| 3,438,757 A | | 4/1969 | Honnen et al. | |
| 3,443,918 A | | 5/1969 | Kantsky et al. | |
| 3,493,354 A | * | 2/1970 | Dorer et al. | 44/331 |
| 3,615,295 A | * | 10/1971 | Manary, Jr. | |

(List continued on next page.)

OTHER PUBLICATIONS

Final Rule, Interium Requirements for Deposit Control Gasoline Additives: Regulatory Text, Oct. 14, 1994, pp. 14–15.

(List continued on next page.)

*Primary Examiner*—Margaret Medley
(74) *Attorney, Agent, or Firm*—Reising, Ethington, Barnes, Kisselle, Learman & McCulloch, P.C.

(57) ABSTRACT

A motor fuel additive composition comprises a mixture of: (a) from about 5 to about 50 weight percent, based upon the total weight of the additive, of a detergent component selected from the group consisting of (i) a reaction product of a substituted hydrocarbon and an amino compound, and (ii) a polybutylamine or polyisobutylamine; and (b) a fuel conditioner component comprising (i) from about 2 to about 50 weight percent, based upon the total weight of the additive, of a polar oxygenated hydrocarbon compound and (ii) from about 2 to about 50 weight percent, based upon the total weight of the additive, of an oxygenated compatibilizing agent. The fuel conditioner component may additionally comprise a hydrophilic separant, an aromatic hydrocarbon, or mixtures thereof. Additionally, in some cases the hydrophilic separant may also act as the compatibilizing agent. The additive may also additionally comprise a carrier oil or fluidizer. The additive is prepared by mixing together the detergent and fuel conditioner components, and is advantageous in that the detergent and fuel conditioner components synergistically interact to reduce both fuel intake system deposit formation and combustion chamber deposit formation, thereby inhibiting engine ORI.

18 Claims, 2 Drawing Sheets

U.S. PATENT DOCUMENTS

| | | | | | |
|---|---|---|---|---|---|
| 3,658,494 | A | | 4/1972 | Dorer, Jr. | |
| 3,658,495 | A | | 4/1972 | Dorer, Jr. | |
| 4,384,872 | A | * | 5/1983 | Kester | |
| 4,486,573 | A | * | 12/1984 | Hayaski | 44/331 |
| 4,652,273 | A | * | 3/1987 | Maldonado et al. | 44/331 |
| 4,753,661 | A | | 6/1988 | Nelson et al. | |
| 4,832,702 | A | * | 5/1989 | Kummer et al. | |
| 4,859,210 | A | * | 8/1989 | Franz et al. | |

OTHER PUBLICATIONS

SAE Technical Paper #941889—Mechanism of Combustion Chamber Deposit Formation, Oct. 17–20, 1994.

SAE Technical Paper #941893—Effects of Gasoline Detergents on Combustion Chamber Deposit Formation, Oct. 17–20, 1994.

SAE Technical Paper #941892—A Physical Mechanism for Deposit Formation in a Combustion Chamber, Oct. 17–20, 1994.

* cited by examiner

MOTOR FUEL ADDITIVE COMPOSITION AND METHOD FOR PREPARATION THEREOF

This application is a continuation-in-part of application U.S. Ser. No. 08/472,179 filed Jun. 7, 1995, now abandoned, which is a continuation-in-part of U.S. Ser. No. 08/198,503 filed Feb. 18, 1994, now abandoned, which is a continuation-in-part of PCT/US91/01332 filed Mar. 5, 1991, which is a continuation-in-part of U.S. Ser. No. 07/488,670 filed on Mar. 5, 1990 now abandoned.

BACKGROUND OF THE INVENTION

1. Field of the Invention

This invention relates to a motor fuel additive composition and a method of preparing such an additive. More particularly, this invention relates to a motor fuel additive composition comprising: (a) a detergent component selected from the group consisting of (i) a reaction product component which is the reaction product of a substituted hydrocarbon and an amino compound, and (ii) a polybutylamine or polyisobutylamine; and (b) a fuel conditioner component comprising (i) a polar oxygenated hydrocarbon compound, and (ii) an oxygenated compatibilizing agent. This invention also relates to a method of preparing a motor fuel additive which comprises mixing the above-described reaction product and fuel conditioner components.

2. Description of the Related Art

Incomplete combustion of hydrocarbonaceous motor fuels in an internal combustion engine is a common problem which generally results in the formation and accumulation of carbon and other deposits in various places, including the fuel inlet system. Significant efforts have previously been undertaken to develop fuel additives to reduce or inhibit deposit formation in the engine fuel inlet system. Early so called "first generation" additives directed primarily to cleaning carburetors and injectors include low molecular weight amine derivatives such as fatty amines, amides, amido amines and imidazolines. Later developed so-called "second generation" additives, directed to cleaning inlet valves as well as carburetors and injectors, have been based primarily on polyolefinic structures, typically polyisobutenes and their derivatives. For example, the use of polybutene succinimides as fuel additives has been disclosed in U.S. Pat. No. 3,443,918 (Kautsky et al.) and U.S. Pat. No. 3,172,892 (LeSeur et al.); the use of polybutene amines as fuel additives has been disclosed in U.S. Pat. No. 3,438,757 (Honnen et al.); the use of a fuel system only cleaning composition based on an oxy compound and a dispersant has been disclosed in U.S. Pat. No. 3,658,494 (Dorer, Jr.).

For effective deposit control, it has been customary to use such additives in conjunction with petroleum based or synthetic carrier oils. Petroleum based oils useful in this respect include naphthenic and paraffinic base stock oils of relatively high viscosity, including so-called Solvent Neutral Oils such as SNO-500 and SNO-600, as well as so-called top cylinder oils and the like. Synthetic oils which have been employed include low molecular weight polypropylenes and polyisobutylenes, as well as polyalkyleneoxides.

Although the above-described additives have been found effective in reducing deposits in the fuel intake system, the increased use of these additives, particularly the second generation additives, in motor fuels has been found to have led to an increase in combustion chamber deposit formation. The presence of deposits in the combustion chamber seriously reduces engine operating efficiency for several reasons. First, deposit accumulation within the combustion chamber inhibits heat transfer between the chamber and the engine cooling system. This leads to higher temperatures within the combustion chamber, resulting in increases in the end gas temperature of the incoming charge. Consequently, end gas auto-ignition occurs, which causes engine knock. In addition, the accumulation of deposits within the combustion chamber reduces the volume of the combustion zone, causing a higher than design compression ratio in the engine. This, in turn, also results in serious engine knocking. A knocking engine does not effectively utilize the energy of combustion. Moreover, a prolonged period of engine knocking will cause stress fatigue and wear in vital parts of the engine. The above-described phenomenon is characteristic of gasoline-powered engines. It is usually overcome by employing a higher-octane gasoline for powering the engine, and hence has become known as engine octane requirement increase (ORI) phenomenon.

The reference SAE paper number 941889, "Mechanism of Combustion Chamber Deposit Formation", Daly, Bannon, Fog and Harold, all of Lubrizol Corp., Oct. 17–20, 1994, teaches a means of determining the mechanism by which CCD are formed, and their association with the phenomenon of octane requirement increase (ORI).

The reference SAE paper number 941892, "A Physical Mechanism for Deopsit Formation in a Combustion Chamber", Cheng, of General Motors Crop., Oct. 17–20 1994, teaches another mechanism for the deposit of CCD in internal combustion engines. It further teaches that it has been universally recognized that combustion chamber deposits are undesirable, but also unavoidable, products of engine combustion. Ever since the inception of internal combustion engines, we have managed to live with combustion chamber deposits, although we really would like to get rid of them, if only we knew how. The reference also teaches that combustion chamber deposits seem to have some beneficial.effects on fuel efficiency.

The reference SAE paper number 941893, "Effects of Gasoline and Gasoline Detergents on Combustion Chamber Deposit Formation", Takei, Uehara, Hoshi, and Okada, all of Toyota Motor Corp., Oct. 17–20, 1994, teaches that the increase in CCD caused by fuel detergent additives and finds that many detergent additives currently available do in fact increase CCD.

The reference "Final Rule Interim Requirements for Deposit Control Gasoline Additives: Regulatory Text", U.S. EPA, Oct. 14, 1994, teaches that the accumulation of CCD resulting from the use of detergent additives used to control fuel system cleanliness is of grave concern and without solution.

In view of the foregoing, it would clearly be advantageous to employ an additive in motor fuel compositions which reduces deposits in engine fuel intake systems and also avoids the formation of deposits in engine combustion chambers, thereby reducing or at least modifying the composition of deposits which tend to cause engine ORI.

It is an object of this invention to provide a motor fuel additive, which is useful in preventing both fuel intake system deposit formation-and combustion chamber deposit formation. It is a feature of this invention that the additive comprises a detergent component and a fuel conditioner component, which synergistically interact to reduce both fuel intake system and combustion chamber deposit formation. It is an advantage of this invention that it both reduces deposit formation in engine fuel intake systems and ORI associated with combustion chamber deposit formation.

It is another object of this invention to provide a method for preparing a motor fuel additive which reduces deposits in engine fuel intake systems and also reduces the formation of deposits in engine combustion chambers, thereby reducing engine ORI. It is another feature of this invention that such an additive is prepared by mixing a detergent component and a fuel conditioner component which synergistically interact to reduce both fuel intake system deposit formation and ORI associated with combustion chamber deposit formation.

SUMMARY OF THE INVENTION

The motor fuel additive composition of this invention comprises a mixture of:

(a) from about 5 to about 50 weight percent, based upon the total weight of the additive, of a detergent component selected from the group consisting of (i) a reaction product of:

(A) a substituted hydrocarbon of the formula $$R_1—X \quad (I)$$

wherein $R_1$ is a hydrocarbyl radical having a molecular weight in the range of 150 to about 10,000, and X is selected from the group consisting of halogens, succinic anhydride and succinic dibasic acid, and (B) an amino compound of the formula $$H—(NH—(A)_m)_n—Y—R_2 \quad (II)$$

wherein Y is O or $NR_5$, $R_5$ being H or a hydrocarbyl radical having 1–30 carbon atoms; A is a straight chain or branched chain alkylene radical having 1–30 carbon atoms; m has a value in the range of 1–15; n has a value in the range of 0–6; and $R_2$ is selected from the group consisting of H, a hydrocarbyl radical having a molecular weight in the range of 15 to about 10,000, and a homopolymeric or heteropolymeric polyoxyalkylene radical of the formula $$R_3—((Q)_a(T)_b(Z)_c)_d— \quad (III)$$

wherein $R_3$ is H or a hydrocarbyl radical having 1–30 carbon atoms, Q, T, and Z are polyoxyalkylene moieties having 1–6 carbon atoms, a, b and c each have values ranging from 0–30, and d has a value in the range of 1–50, and (ii) a polybutylamine or polyisobutylamine of the formula

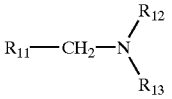

(IV)

where $R_{11}$ is a polybutyl or polyisobutyl radical derived from isobutene and up to 20% by weight of n-butene and $R_{12}$ and $R_{13}$ are identical or different and are each hydrogen, an aliphatic or aromatic hydrocarbon, a primary or secondary, aromatic or aliphatic aminoalkylene radical or polyaminoalkylene radical, a polyoxyalkylene radical or a heteroaryl or heterocyclyl radical, or, together with the nitrogen atom to which they are bonded, form a ring in which further hetero atoms may be present; and (b) a fuel conditioner component comprising:

(i) from about 2 to about 50 weight percent, based upon the total weight of the additive, of a polar oxygenated hydrocarbon having an average molecular weight in the range of about 200 to about 500, an acid number in the range of about 25 to about 175, and a saponification number in the range of about 30 to about 250, and (ii) from about 2 to about 50 weight percent, based upon the total of the additive, of an oxygenated compatibilizing agent having a solubility parameter in the range of about 7.0 to about 14.0 and moderate to strong hydrogen-bonding capacity.

The fuel conditioner component may additionally comprise a hydrophilic separant such as a glycol monoether, and an aromatic hydrocarbon such as xylene or a xylene. The additive composition may additionally comprise a carrier oil or fluidizer.

This invention is also directed to a method of preparing the motor fuel additive of this invention, which comprises mixing the detergent and fuel conditioner components to obtain the additive. The motor fuel additive of this invention is advantageous in that the detergent and fuel conditioner components synergistically interact when employed in a fuel composition to reduce both fuel intake system deposit formation, thereby improving engine performance, and combustion chamber deposit formation, thereby reducing engine ORI.

DESCRIPTION OF THE PREFERRED EMBODIMENTS

Figure 1:
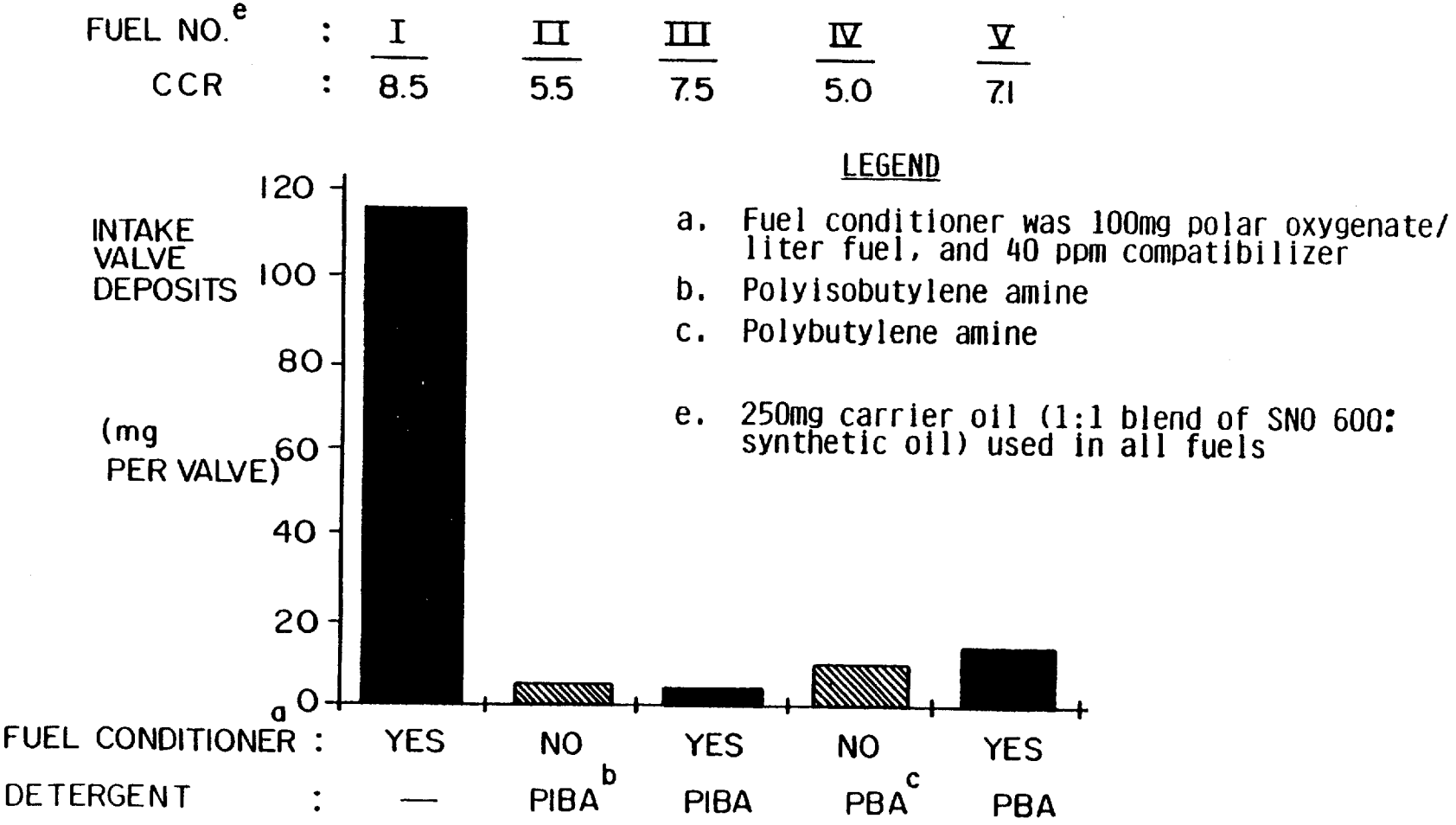
FIG. 1 depicts the results of engine test stand experiments for various motor fuel compositions, including motor fuel compositions containing the additive of this invention.

This invention is directed to a motor fuel additive and to a method for the preparation thereof. The additive comprises: (a) a detergent component which is selected from the group consisting of (i) the reaction product of a substituted hydrocarbon and an amino compound, (ii) a polybutylamine or polyisobutylamine; and (b) a fuel conditioner component comprising a polar oxygenated hydrocarbon compound and an oxygenated compatibilizing agent.

If the reaction product detergent component is employed, the substituted hydrocarbon reactant used to prepare the reaction product is of the formula $$R_1—X \quad (I)$$

wherein $R_1$ is a hydrocarbyl radical having a molecular weight in the range of about 150 to about 10,000, preferably a polyalkylene radical having a molecular weight in the range of about 400 to about 5000, most preferably a polyalkylene radical having a molecular weight in the range of about 600 to about 1500, and X is selected from the group consisting of halogens, preferably chlorine, succinic anhydride and succinic dibasic acid in one preferred embodiment, $R_1$—X is a polyisobutenyl succinic anhydride. In another preferred embodiment, $R_1$—X is a chloropolyisobutylene.

The amino compound reactant used to prepare the reaction product is of the formula $$H—(NH—(A)_m)_n—Y—R_2 \quad (II)$$

wherein Y is O or $NR_5$, $R_5$ being H or a hydrocarbyl radical having 1–30 carbon atoms, preferably 1–22 carbon atoms; A is a straight chain or branched chain alk ylene radical having 1–30, preferably 1–15 carbon atoms; m has a value in the range of 1–15, preferably 1–12; n has a value in the range of 0–6, preferably 0–5; and $R_2$ is selected from the group consisting of H, a hydrocarbyl radical having a molecular weight in the range of about 15 to about 10,000, preferably 15 to about 2000, and a homopolymeric or heteropolymeric polyoxyalkylene radical of the formula $$R_3—((Q)_a(T)_b(Z)_c)_d— \quad (III)$$

wherein $R_3$ is H or a hydrocarbyl radical having 1–30, preferably 1–22 carbon atoms, Q, T, and Z are polyoxyalkylene moieties having 1–6 carbon atoms, a, b, and c each have values ranging from 0–30, and d has a value in the range of 1–50, preferably 1–25.

Various preferred embodiments of the amino compound reactant of formula (II) are given in Table 1 below:

TABLE 1

1. $A = CH_2$, m = 2, n = 3, $Y = NR_5$, $R_5$ = H, $R_2$ = H, yields an amino compound reactant of the formula: $NH_2—(CH_2)_2—NH—(CH_2)_2—NH—(CH_2)_2—NH_2$
2. $A = CH_2$, m = 3, n = 1, $Y = NR_5$, $R_5$ = H, $R_2$ = oleyl radical, yields an amino compound reactant of the formula: $NH_2—(CH_2)_3—NH$-oleyl
3. $A = CH_2$, m = 6, n = 1, $Y = NR_5$, $R_5$ = H, $R_2$ = H, yields an amino compound reactant of the formula: $NH_2—(CH_2)_6—NH_2$
4. $A = CH_2$, m = 12, n = 1, $Y = NR_5$, $R_5$ = H, $R_2$ = H, yields an amino compound reactant of the formula: $NH_2—(CH_2)_{12}—NH_2$
5. $A = (CH_2)_2—CH(CH_3)—(CH_2)_3$, m = 1, n = 1, $Y = NR_5$, $R_5$ = H, $R_2$ = H, yields an amino compound reactant of the formula:

$NH_2—(CH_2)_2—CH(CH_3)—(CH_2)_3—NH_2$
6. $A = (CH_2)_2—CH(CH_3)—CH_2—CH(CH_3)—CH_2$, m = 1, n = 1, $Y = NR_5$, $R_5$ = H, $R_2$ = H, yields an amino compound reactant of the formula:

$NH_2—(CH_2)_2—CH(CH_3)—CH_2—CH(CH_3)—CH_2—NH_2$

In another preferred embodiment, $R_2$ is the above-described homopolymeric or heteropolymeric polyoxyalkylene radical of formula (III). As used in this description and in the appended claims, the terms homopolymeric and heteropolymeric refer to polyoxyalkylene compounds, which in the case of homopolymeric compounds contain one recurring polyoxyalkylene moiety, and in the case of heteropolymeric compounds contain more than one recurring polyoxyalkylene moiety, typically having 1–6 carbon atoms, such as ethylene oxide (EO), propylene oxide (PO) or butylene oxide (BO). Thus, for example, in one embodiment $R_2$ may be a homopolymeric polyoxyalkylene radical of the formula $$R_3—((EO))_d—$$

wherein in formula (III), a=1, b=0, c=0, Q=ethylene oxide, and $R_3$ and d are as previously defined. In another embodiment, $R_2$ may be a heteropolymeric polyoxyalkylene radical of the formula $$R_3—((EO)_a(PO)_b(BO)_c)_d—$$

wherein, in formula III, Q=ethylene oxide, T=propylene oxide, Z=butylene oxide, and a, b, c, d and $R_3$ are as previously described.

In yet another preferred embodiment, the above-described amino compound reactant is selected from the group consisting of polyethylene polyamines, polypropylene polyamines and mixtures thereof. In yet another preferred embodiment, such polyamines are monoalkylated.

The reaction product component is preferably prepared by reacting the substituted hydrocarbon $R_1—X$ to the amino compound in a mole ratio in the range of 0.2:1–20:1, more preferably in the range of 0.5:1–10:1. The reaction product component may be prepared under reaction conditions (including e.g. reaction times, temperatures, and reagent proportions) as are well known by those skilled in the art for preparing such amino compound-substituted hydrocarbon reaction products. The method for preparing such reaction products is described, for example, in U.S. Pat. No. 3,172,892 (LeSeur et al.), U.S. Pat. No. 3,438,757 (Honnen et al.), and U.S. Pat. No. 3,443,918 (Kautsky et al.), all of which are incorporated herein by reference.

The detergent compound may also be a polybutylamine or polyisobutylamine of the formula (I)

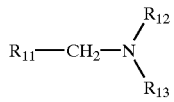

(IV)

where $R_{11}$ is a polybutyl- or polyisobutyl radical derived from isobutene and up to 20% by weight of n-butene, and $R_{12}$ and $R_{13}$ are identical or different and are each hydrogen, an aliphatic or aromatic hydrocarbon, a primary or secondary, aromatic or aliphatic aminoalkylene radical or polyaminoalkylene radical, a polyoxyalkylene radical or a heteroaryl or heterocyclyl radical, or, together with the nitrogen atom to which they are bonded, form a ring in which further hetero atoms may be present.

Compounds of the general formula (IV) and the method of preparation thereof are disclosed, for example, in U.S. Pat. No. 4,832,702 (Kummer et al.), incorporated herein by reference. Compounds of the general formula (IV) are preferably prepared in accordance with the method disclosed in U.S. Pat. No. 4,832,702, wherein an appropriate polybutene or polyisobutene is hydroformylated with a rhodium or cobalt catalyst in the presence of CO and $H_2$ at from about 80–200° C. and CO/H 2 pressures of up to 600 bar, and the oxo product thereby formed is then subjected to a Mannich reaction or amination under hydrogenating conditions, wherein the amination reaction is advantageously carried out at 80–200° C. and under pressures up to 600 bar, preferably 80–300 bar.

The fuel conditioner component employed in admixture with the detergent component to produce the additive of this invention may preferably be the fuel conditioner previously disclosed in U.S. Pat. No. 4,753,661 (Nelson et al.), incorporated herein by reference. This fuel conditioner comprises a polar oxygenated hydrocarbon compound and an oxygenated compatibilizing agent.

The polar oxygenated hydrocarbon portion of the fuel conditioner signifies various organic mixtures arising from the controlled oxidation of petroleum liquids with air. Often these air oxidations of liquid distillates are carried out at a temperature of from about 100° C. to about 150° C. with an organo-metallic catalyst, such as esters of manganese, copper, iron, cobalt, nickel or tin, or organic catalysts, such as tertiary butyl peroxide. The result is a meiange of polar oxygenated compounds which may be divided into at least three categories: volatile, saponifiable and non-saponifiable.

The polar oxygenated compounds preferable for use in the present invention may be characterized in a least three ways, by molecular weight, acid number, and saponification number. It is to be appreciated by those skilled in the art that the terms "molecular weight" and "average molecular weight" are synonymous and are herein used interchangeably. It is to be further appreciated that there are several methods of determining the average molecular weight of an organic material and that different methods will produce different results for the same material. Chemically these oxidation products are mixtures of acids, hydroxy acids, lactones, eaters, ketones, alcohols, anhydrides, and other oxygenated organic compounds. Those suitable for the present invention are compounds and mixtures with an average molecular weight between about 200 and about 500, with an acid number between about 25 and about 175 (ASTM-D-974), and a saponification number from about 30 to about 250 (ASTM-D-974-52). Preferably the polar oxygenated compounds of the present invention have an acid number from about 50 to about 100 and a saponification number from about 75 to about 200. An example of a polar oxygenated hydrocarbon within this preferred range is ALOX 400L (Alox Corporation, Niagara Falls, N.Y.).

Suitable compatibilizing agents for use in the fuel conditioner component of the instant invention are organic compounds of moderate solubility parameter and moderate to strong hydrogen-bonding capacity. Solubility parameters, $\delta$, based on cohesive energy density are a fundamental descriptor of an organic solvent giving a measure of its polarity. Simple aliphatic molecules of low polarity have a low $\delta$ of about 7.3; highly polar water has a high $\delta$ of 23.4. Solubility parameters, however, are just a first approximation to the polarity of an organic solvent. Also important to generalized polarity, and hence solvent power, are dipole moment and hydrogen-bonding capacity. Symmetrical carbon tetrachloride and some aromatics with low gross dipole moment and poor hydrogen-bonding capacity have a solubility parameter of about 8.5. In contrast, methyl propyl ketone has almost the same solubility parameter, 8.7, but quite strong hydrogen-bonding capacity and a definite dipole moment. Thus, no one figure of merit alone describes the "polarity" of an organic solvent.

For the practice of the present invention a compatibilizing agent preferably having a solubility parameter from about 7.0 to about 14.0 and moderate to strong hydrogen-bonding capacity. Suitable classes of organic solvents are alcohols, ketones, esters, and ethers. Preferred compatibilizing agents are straight-chain, branched-chain, and alicyclic alcohols with from six to 14 carbon atoms. Especially preferred compounds for compatibilizing agents are the hexanols, the heptanols, the octanols, the nonyl alcohols, the decanols, and the dodecanols.

The fuel conditioner component of this invention may additionally include a hydrophilic separant which decreases the amount of water in the hydrocarbon fuel, thus improving combustion. Suitable separants for practicing the current invention are ethers of glycols or polyglycols, especially monoethers. Monoethers are preferred over diethers in the practice of the present invention.

Examples of such compounds which may be used are the monoethers of ethylene glycol, propylene glycol, trimethylene glycol, alphabutylene glycol, 1,3-butanediol, beta-butylene glycol, isobutylene glycol, tetramethylene glycol, hexylene glycol, diethylene glycol, dipropylene glycol, tripropylene glycol, triethylene glycol, tetraethylene glycol, 1,5-pentanediol, 2-methyl-2-ethyl-1,3-propanediol, 2-ethyl-1,3-hexanediol. Some monoethers include ethylene glycol monophenyl ether, ethylene glycol monomethylether, ethylene glycol monoethyl ether, ethylene glycol mono-(n-butyl) ether, diethylene glycol monomethyl ether, diethylene glycol monoethyl ether, diethylene glycol mono-(n-butyl) ether, propylene glycol monomethyl ether, dipropylene glycol monomethyl ether, diethylene glycol monocyclohexylether, ethylene glycol monobenzyl ether, triethylene glycol monophenethyl ether, butylene glycol mono-(p-(n-butoxy) phenyl) ether, trimethylene glycol mono(alkylphenyl) ether, tripropylene glycol monomethyl ether, ethylene glycol mono-isopropyl ether, ethylene glycol monoisobutyl ether, ethylene glycol monohexyl ether, triethylene glycol monobutyl ether, triethylene glycol monomethyl ether, triethylene glycol monoethyl ether, 1-butoxyethoxy-2-propanol, monophenyl ether of polypropylene glycol having an average molecular weight of about 975 to 1075, and monophenyl ether of polypropylene glycol wherein the polyglycol has a average molecular weight of about 400 to 450, monophenyl ether of polypropylene glycol wherein the polypropylene glycol has an average molecular weight of about 975 to 1075. Such compounds are sold commercially under trade names such as Butyl CELLOSOLVE, Ethyl CELLOSOLVE, Hexyl CELLOSOLVE, Methyl CARBITOL, Butyl CARBITOL, DOWANOL Glycol ethers, and the like.

In the practice of the current invention, it has been found useful to include an aromatic hydrocarbon, or a mixture of such, in the fuel conditioner component of the present invention. Any aromatic hydrocarbon blend that is liquid at room temperature is suitable. Among these are benzene, toluene, the three xylenes, trimethylbenzene, durene, ethylbenzene, cumene, biphenyl, dibenzyl and the like or their miixtures. The preferred aromatic constituent is a commercial mixture of the three xylenes, because it is cheaper than any pure xylene. As used in this description and in the appended claims, the word "xylene" means not only the three specific xylene compounds o-xylene, m-xylene and p-xylene, but also includes aromatic "cuts" or distillates of aromatic hydrocarbons containing not only xylene but benzene, toluene, durene and naphthalene which may be mixed in the xylene. Aromatic naphthas are also useful. Without being limited to any theory or hypotheses for the use of an aromatic hydrocarbon, it has been found that the presence of an aromatic hydrocarbon in the conditioner promotes clean and efficient combustion of the fuel.

The composition of this invention may additionally comprise a suitable amount of a carrier oil or fluidizer selected from the group consisting of petroleum-based oils, mineral oils, polypropylene compounds having a molecular weight in the range of about 500 to about 3000, polyisobutylene compounds having a molecular weight in the range of about 500 to about 3000, polyoxyalkylene compounds having a molecular weight in the range of about 500 to about 3000, and polybutyl and polyisobutyl alcohols containing polybutyl or polyisobutyl radicals derived from polyisobutene and up to 20% by weight of n-butene, corresponding carboxylates of the polybutyl or polyisobutyl alcohol, and mixtures thereof. Petroleum based oils which may be employed include top cylinder oils as well as both natural and synthetic naphthenic and paraffinic base stock oils of relatively high viscosity, including so-called Solvent Neutral Oils (SNO) such as SNO-500 and SNO-600. Mineral oils which may be employed include so-called "light" mineral oils, i.e. those petroleum, aliphatic or alicyclic fractions having a viscosity less than about 10,000 SUS at 250° C. A mixture of hydrocarbon fractions may also be employed in place of a base stock. The above described polybutyl and polyisobutyl alcohols include those disclosed in U.S. Pat. No. 4,859,210 (Franz et al.), incorporated herein by reference. As used in this description and in the appended claims, the terms "carrier oil" and "fluidizer" are interchangeable, as will be readily understood by those skilled in the art.

Given the presence of the many constituents described above, a wide variety of proportions are suitable for the additive composition of this invention. Below a "Useful Range" and a "Preferred Range" are given in weight percent, based upon the total weight of the additive composition:

TABLE 2

| Component | Useful Range | Preferred Range |
|---|---|---|
| Detergent Component | 5 to about 50 | 10–30 |
| Polar Oxygenated Compound | about 2 to about 50 | 5–25 |
| Compatibilizing Agent | about 2 to about 50 | 5–25 |
| Hydrophilic Separant | 0–40 | 0–30 |
| Aromatic Hydrocarbon | 0–80 | 0–30 |
| Carrier Oil | 0–80 | 0–60 |

The additive composition of this invention may be employed in a wide variety of hydrocarbon or modified hydrocarbon (e.g. alcohol-containing) fuels for a variety of engines. Preferred motor fuel compositions for use with the additive composition of this invention are those intended for use in spark ignition internal combustion engines. Such motor fuel compositions, generally referred to as gasoline base stocks, preferably comprise a mixture of hydrocarbons boiling in the gasoline boiling range, preferably form about 90–450° F. This base fuel may consist of straight chains, branch chains, paraffins, cycloparaffins, olefins, aromatic hydrocarbons, and mixtures thereof. The base fuel may be derived from, among others, straight run naphtha, polymer gasoline, natural gasoline, or from catalytically cracked or thermally cracked hydrocarbons and catalytically reformed stock. The fuel may also contain synthetic hydrocarbons, ethers such as methyl tertiary butyl ether (MTBE), ethyl tertiary butyl ether (ETBE) and the like, alcohols such as methanol, ethanol, TBA and the like, and other functional organic compounds such as ketones, esters and the like. The composition and octane level of the base fuel are not critical and any conventional motor base fuel may be employed in the practice of this invention. In addition, the motor fuel composition may additionally comprise other additives typically employed in motor fuels, such as anti-knock compounds (e.g. tetraethyl lead), anti-icing additives, upper cylinder lubricating oils, carburetor detergents, anti-corrosion additives, de-emulsifying agents, odor suppressors, and the like.

Having described this invention above, it is now illustrated in the following examples. These examples, however, do not limit the application of this invention, which may be carried out by other means in other systems.

EXAMPLE 1

Comparative Example

Two automobiles (a Ford Escort and a Chevrolet Cavalier) were driven for 7000 miles (30% town driving, 70% highway driving) using the same unleaded base gasoline containing no detergent additives, the gasoline having a (RON+MON)/2 octane number=87. Before beginning the test, the engines were disassembled and the combustion chambers thereof were completely cleaned. They were then reassembled withnew spark plugs and new valves. After the 7000 mile driving test the engines were disassembled again and the deposits accumulated on the tulip of the inlet valves and in the combustion chamber were collected and weighed. The results are summarized below:

| | Car #1 | Car #2 |
|---|---|---|
| Automobile Make/Model | Ford Escort | Chevrolet Cavalier |
| Cylinders | I-4 | V-6 |
| Injector | FI | PFI |
| Inlet Valve deposits (g)* | 1.1 | 1.35 |
| Combustion Chamber deposits (g)* | 0.95 | 1.1 |

*per unit

EXAMPLE 2

Comparative Example

The identical test performed in Example 1 was repeated except that each vehicle used an unleaded base fuel containing a different commercially available fuel detergent additive package at its recommended level. After 7000 miles, the following results were obtained:

| | Car #1 | Car #2 |
|---|---|---|
| Additive Type | A* | B** |
| Inlet Valve deposits (g) | 0.5 | <0.1 |
| Combustion Chamber deposits (g) | 1.45 | 1.7 |

*Additive A = 250 ppm of EDP-892 available from Elf Refinery Solaize, France, a polybutene succinimide type additive*** + 500 ppm SNO 600.
Additive B = 350 ppm of AP-58 available from BASF Corp. or Amoco-596 available from Amoco Corp., a polybutene amino type additive* + 600 ppm top cylinder oil.
***Reaction products of a substituted hydrocarbon and an amino compound.

The results above indicate that altough commercial additives A and B improved inlet valve cleanliness in comparison with Example 1, combustion chamber deposit formation actually increased, thereby detrimentally enhancing engine ORI.

EXAMPLE 3

Comparative Example

The identical test performed in Example I was run, except that each vehicle used an unleaded base fuel containing 500 ppm of the fuel conditioner component of this invention, as disclosed in U.S. Pat. No. 4,753,661 and available from Polar Molecular Corp. (Saginaw, Mich.) under the DurAlt Fuel Conditioner trade name.* The following results were obtained:

| | Car #1 | Car #2 |
|---|---|---|
| Inlet Valve deposits (g) | 1.27 | 1.45 |
| Combustion Chamber deposits (g) | 0.48 | 0.5 |

* Contained 30% (by weight of fuel conditioner) active polar oxygenated compound.

EXAMPLE 4

Invention

The identical test performed in Example 1 was run, except that each vehicle used an unleaded base fuel containing its respective additive (A or B) as in Example 2 plus 500 ppm of the fuel conditioner component of this invention available from Polar Molecular Corp. (Saginaw, Mich.) under the DurAlt Fuel Conditioner trade name. The following results were obtained:

| | Car #1 | Car #2 |
|---|---|---|
| Additive Type | A + 500 ppm DurAlt | B + 500 ppm DurAlt |
| Inlet Valve deposits (g) | 0.35 | <0.1 |
| Combustion Chamber deposits (g) | 0.45 | 0.4 |

The results above show that the additive composition of this invention, when employed in a motor fuel composition, reduces both inlet valve deposits and combustion chamber deposits, and hence tends to reduce engine ORI. These results are unexpected, in that the use of additives A and B without the DurAlt fuel conditioner (as in Example 2) showed much greater (i.e. 3–4 times greater) combustion chamber deposit formation, and hence greater ORI tendencies. Thus, the combination of the detergent and fuel conditioner components in the additive composition of this invention synergistically acts to reduce both intake valve deposit formation and combustion chamber deposit formation.

EXAMPLE 5

Invention

The identical test performed in Example 1 was run, except that each vehicle used an unleaded base fuel containing its respective additive (A or B) as in Example 2 plus 300 ppm and 100 ppm, respectively, of the DurAlt fuel conditioner. The following results were obtained:

| | Car #1 | Car #2 |
|---|---|---|
| Additive Type | A + 300 ppm DurAlt | B + 100 ppm DurAlt |
| Inlet Valve deposits (g) | 0.37 | <.01 |
| Combustion Chamber deposits (g) | 0.40 | 0.85 |

The results above again show that the additive composition of this invention, when employed in a motor fuel composition, reduces both inlet valve deposits and combustion chamber deposits, and hence tends to reduce engine ORI. These results are again unexpected, in that the use of additives A and B without the DurAlt fuel conditioner (as in Example 2) showed much greater (i.e. 2–3 times greater) combustion chamber deposit formation, and hence greater ORI tendencies. Thus, the combination of the detergent and fuel conditioner components in the additive composition of this invention synergistically acts to reduce both intake valve deposit formation and combustion chamber deposit formation.

EXAMPLE 6

Comparative Example

The identical test performed in Example 1 was run for Car #2, except that Car #2 used an unleaded base fuel having additive package B plus 500 ppm of a commercial fuel additive as disclosed in U.S. Pat. No. 4,548,616 (Sung et al.), the additive being a poly (oxyethylene)(oxypropylene) polyol. Such additives are available from BASF Corp. under the PLURADYNE series trade name. The following results were obtained:

| | Car #2 |
|---|---|
| Additive Type | B + 500 ppm PLURADYNE AP-58* |
| Inlet Valve deposits (g) | <0.1 |
| Combustion Chamber deposits (g) | 1.2 |

*PLURADYNE AP-58, a product of BASF Corp., is a poly(oxyethylene)-poly(oxypropylene)-poly(oxyethylene)polyol having a molecular weight of about 950 containing about 10 wt. % derived from poly(oxyethylene) and about 90% derived from poly(oxypropylene).

The above results show that a combination of additive package B plus poly (oxyethylene) poly (oxypropylene) polyol (PLURADYNE AP-58) is less effective in controlling combustion chamber deposit formation, and hence engine ORI, than the additive of this invention, as exemplified in Examples 4 and 5.

EXAMPLE 7

Invention

A Honda Accord, I4 engine with 2-barrel carburetor and mileage of 64,550 miles, run primarily on leaded gasoline containing commercially available additives, was found to have knocking problems. This vehicle was then run for 2000 miles on a fuel containing an additive composition of this invention, namely an additive composition comprising additive 3 as set forth in Example 2 (i.e. 350 ppm polybutene amino type additive and 600 ppm top cylinder oil)+500 ppm of DurAlt FC. The knocking problems totally disappeared, thus showing a clear reduction in engine ORI for this vehicle. This example illustrates the utility of this invention in so-called "clean-up" applications, wherein use of the invention improves performance of engines which have already demonstrated engine ORI.

Additional experimental results were obtained using a ES6500 Honda generator engine testing system. Two identical engine systems having identical loading (1500 and 2500 watt electrical resistance hot water heaters) were employed, in accordance with the testing procedure set forth in M. Megnin et al., "Development of a Gasoline Additive Screening Test for Intake Valve Stickiness and Deposit Levels," SAE Paper No. 892121 (presented at the Int'l Fuels and Lubricants Meeting, Baltimore, Md. September. 1989), incorporated herein by reference, which was modified as follows.

The engine was prepared for testing by first being disassembled. The intake valves were then cleaned with gum solvent consisting of a mixture of ⅓ acetone, ⅓ toluene, and ⅓ methanol to remove any lube oil on the valves. The valves were then stored in a desiccator for at least one hour, and thereafter weighed to the nearest 0.1 mg, just prior to engine assembly. The combustion chambers and ports were cleaned with a suitable wire brush, as were the tops of the pistons. The clean cylinder heads were reassembled and installed onto the engine, and the remainder of the engine was reassembled. The oil and oil filter were replaced prior to testing.

The fuel composition to be tested was prepared and poured into the fuel tank. The engine was started and allowed to idle for 30 second to warm up. The engine was then allowed to run under a 1500 watt load for two hours. At the end of the two hour period, the generator load, coolant in/out temperature, oil temperature, exhaust temperature for cylinders 1 and 2, and manifold vacuum were recorded. The engine was then run for an additional two hour period under a 2500 watt load. At the end of this two hour period, the above-described data were again recorded. The above-described four hour test run procedure was repeated (with intervening refueling) for 16 hours of engine running per day, for five consecutive, days for a total of 80 hours of engine running. At the end of the 80 hour period, the generator fuel tank was drained and added to the remaining fuel mix for the run. The total volume of fuel remaining was measured to calculate the amount of fuel-used during the 80 hour run.

After completion of the 80 hour run, the engine was disassembled, including removal of the cylinder head, cam shaft, and rocker arm assembly. The amount of deposits on the intake system, consisting of the carburetor throttle plate, intake manifold, head runners, head ports, and intake valves were rated using the method described by Coordinating Research Council (CRC) Rating Manual No. 16, Atlanta, Ga. 1987 ("CRC Rating"), which is well known to those skilled in the art. The combustion chamber and piston tops were similarly rated using the CRC Rating system. The sequence for rating, valve weighing, and photographing was as follows: the piston tops, cylinder head, combustion chamber, head runners, intake manifold, and throttle plate were all initially rated, and photographed. The combustion side of the intake valves were thereafter cleaned, and the intake valves were removed carefully so as to not disturb any deposits residing thereon. The valve stems were wiped with gum solvent to remove lube oil, and thereafter photographed. The valves were then placed in a desiccator for one hour and then removed and immediately weighed, with the weight being recorded to the nearest 0.1 mg. The valves were then put back into the desiccator for an additional 0.5 hour and reweighed, this process was repeated until valve weighings were within 0.5 mg. The valve was then cleaned with gum solvent and wire brush, and stored in a desiccator until ready for final weighing. The engine was thereafter reassembled with a new set of intake valves, and the engine runs were repeated.

A base fuel composition obtained from the Sun Refining and Marketing Company was used in all of the following examples. The analysis of the base fuel composition was as follows:

| Item | Result |
|---|---|
| API Gravity, ASTM D287 | 56.1 |
| Research Octane No., ASTM D2699 | 95.2 |
| Motor Octane, ASTM D2700 | 84.2 |
| Sensitivity, (R − M) | 11.0 |
| Octane, (R + M)/2 | 89.7 |
| Reid Vapor Pressure, psi | 9.1 |
| ASTM D323 Automated Distillation, ASTM D86 Automated | |
| IBP | 93 |
| 10% Evap. | 131 |
| 50% Evap. | 220 |
| 90% Evap. | 336 |
| FBP | 411 |
| Hydrocarbon Composition, Vol. %, ASTM D1319 | |
| Aromatics | 30.4 |
| Olefins | 17.1 |
| Saturates | 52.5 |

The base fuel composition, without any additives, was tested in each of the two Honda engine systems to obtain comparative results. Both intake valve deposit weights (in milligrams) and combustion chamber ratings (according to the CRC method, as previously described) were obtained for each of the two engines as follows:

EXAMPLE 8

Comparative Example (Comparative Example)

| | Engine No. 1 | Engine No. 2 |
|---|---|---|
| Intake Valve Deposits (Mg)* | 108.8 | 97.7 |
| Combustion Chamber Rating (CRC) | 8.1 | 8.0 |

*Each is average of two runs

**In accordance with the CRC Rating Method, the combustion chamber is rated from 1–10, with "1" being very "dirty" (i.e. very heavy deposits) and "10" being completely free of deposits. It is well known to those skilled in the art that reduction of combustion chamber deposits (i.e. high CRC Rating Number) can have a significant positive effect on ORI of vehicles as well as reduced amounts of exhaust emissions.

A variety of fuel compositions, including fuel compositions containing the additive composition of this invention were tested using the above-described procedure in the Honda generator engines in order to obtain intake valve deposit measurements and combustion chamber rating measurements. These test results are set forth below:

EXAMPLE 9

Motor fuel compositions were prepared using the base fuel composition from Sun Refining and Marketing Company, and additionally having the following additives:

| Fuel No. | Detergent Component (250 mg/l fuel) | Fuel Conditioner** Component | Carrier Oil* (250 mg) |
|---|---|---|---|
| I (comparative) | — | yes | yes |
| II (comparative) | polyisobutylamine*** | — | yes |

-continued

| Fuel No. | Detergent Component (250 mg/l fuel) | Fuel Conditioner** Component | Carrier Oil* (250 mg) |
|---|---|---|---|
| III (invention) | polyisobutylamine*** | yes | yes |
| IV (comparative) | polybutylamine**** | — | yes |
| V (invention) | polybutylamine**** | yes | yes |

Figure 2:
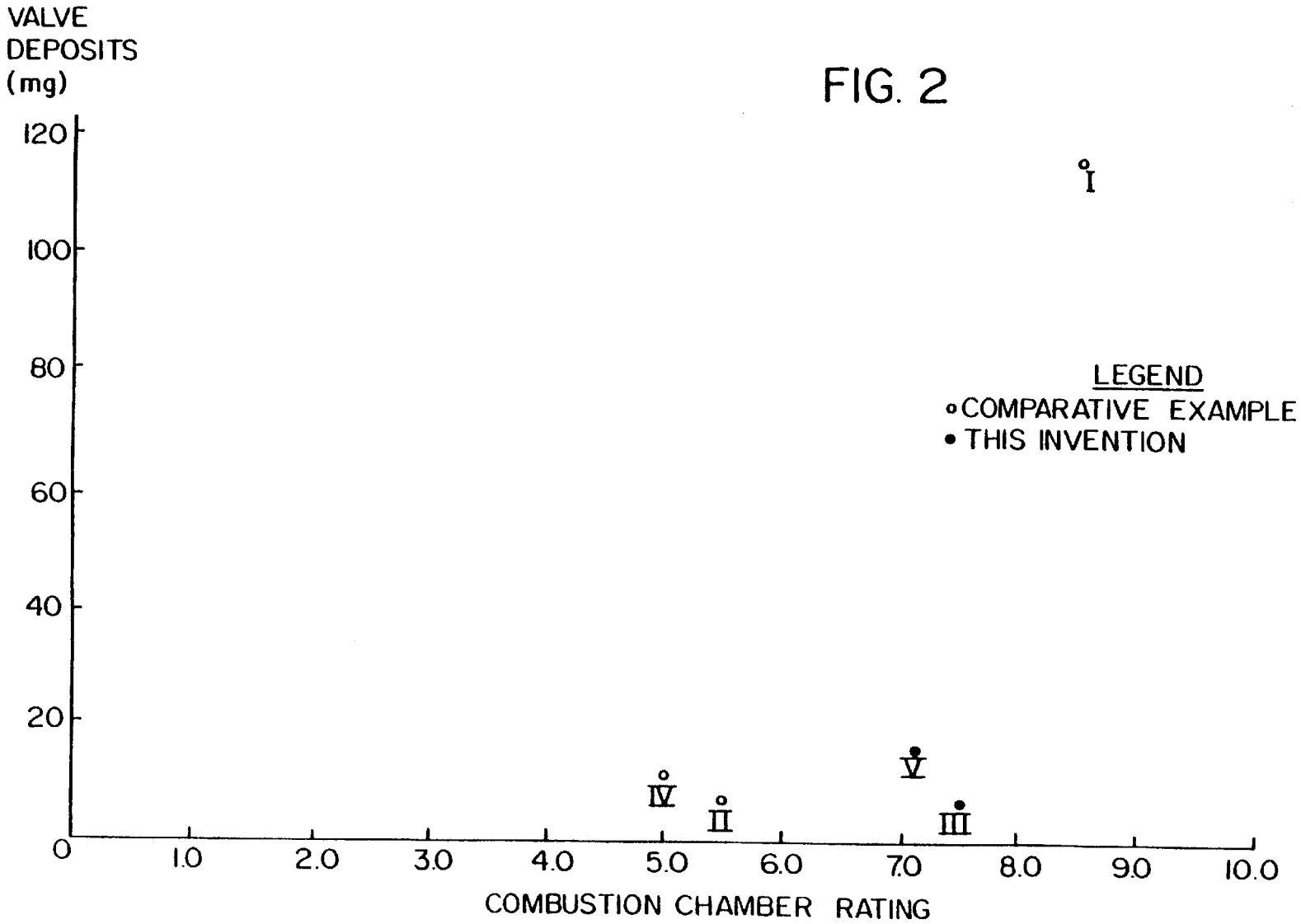
FIG. 2 depicts the results of the engine test stand experiments set forth in FIG. 1 for various motor fuel compositions, including motor fuel compositions containing the additive of this invention, as a plot of Combustion Chamber Rating vs. Intake Valve Deposits (mg).

*In Fuel Nos. I–V, carrier oil used was 250 mg of 1:1 blend of SNO 600 oil and synthetic oil.
**Fuel conditioner component was 100 mg/l fuel polar oxygenated hydrocarbon plus 40 ppm compatibilizer (hexanol).
***BASF 35-B available from BASF Corporation
**Amoco 596 available from AMOCO Corporation Fuels Nos. I–V were rated in terms of the amount of intake valve deposits (in mg) and for combustion chamber (CRC) rating, as summarized in FIG. 1. As is clear from FIG. 2, which plots the data set forth in FIG. 1**, Fuel Nos. III, and V (i.e. the fuel compositions comprising the additive of this invention) exhibited superior properties both in terms of combustion chamber rating (i.e. high CRC rating) and reduction of intake valve deposits (i.e. low value of mg of deposits on intake valves).

It will be evident that the terms and expressions employed herein are used as terms of description and not of limitation. There is no intention, in the use of these descriptive terms and expressions, of excluding equivalents of the features described and it is recognized that various modifications are possible within the scope of the invention claimed.

What is claimed is:

1. An effective octane reducing motor fuel additive composition which reduces and modifies both fuel intake system and combustion chamber deposit formation of an engine consisting essentially of a mixture of:

(a) from about 5 to about 50 weight percent, based upon the total weight of the additive, of a detergent component selected from the group consisting of (i) a reaction product of:

(A) a substituted hydrocarbon of the formula $$R_1—X \quad (I)$$

wherein $R_1$ is a hydrocarbyl radical having a molecular weight in the range of about 150 to about 10,000, and X is selected from the group consisting of halogens, succinic anhydride and succinic dibasic acid, and (B) an Juno compound of the formula $$H—(NH—(A)_m)_n—Y—R_2 \quad (II)$$

wherein Y is O or $NR_5$, $R_5$ being H or a hydrocarbyl radical having 1–30 carbon atoms; A is a straight chain or branched chain alkylene radical having 1–30 carbon atoms; m has a value in the range of 1–15; n has a value in the range of 0–6; and $R_2$ is selected from the group consisting of H, a hydrocarbyl radical having a molecular weight in the range of about 15 to about 10,000, and a homopolymeric or heteropolymeric polyoxyalkylene radical of the formula $$R_3—((Q)_a(T)_b(Z)_c)_d— \quad (III)$$

wherein $R_3$ is H or a hydrocarbyl radical having 1–30 carbon atoms, Q, T, and Z are polyoxyalkylene moieties having 1–6 carbon atoms, a, b and c each have values ranging from 0–50, and d has a value in the range of 1–50, and (ii) a polybutylanine or polyisobutylamine of the formula

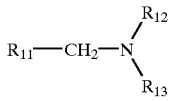

(IV)

where $R_{11}$ is a polybutyl or polyisobutyl radical derived from isobutene and up to 20% by weight of n-butene and $R_{12}$ and $R_{15}$ are identical or different and are each hydrogen, an aliphatic or aromatic hydrocarbon, a primary or secondary, aromatic or aliphatic aminoalkylene radical or polyamioalkylene radical, a polyoxyalkylene radical or a heteroaryl or heterocyclyl radical, or, together with the nitrogen atom to which they are bonded, form a ring in which further hetero atoms may be present; and (b) a fuel conditioner consisting essentially of:

(i) from about 2 to about 50 weight percent, based upon the total weight of the additive, of a polar oxygenated hydrocarbon having an average molecular weight in the range of about 200 to about 500, an acid number in the range of about 25 to about 175, and a saponification number in the range of about 30 to about 250, and (ii) from about 2 to about 50 weight percent, based upon the total of the additive, of an oxygenated compatibilizing agent having a solubility parameter in the range of about 7.0 to about 14.0 and moderate to strong hydrogen-bonding capacity.

2. A composition according to claim 1, in which the mole ratio of the substituted hydrocarbon $R_1$—X to the amino compound is in the range of 0.2:1 to 20:1.

3. A composition according to claim 1, in which $R_1$—X is a chloropolyisobutylene or a polyisobutenyl succinic anhydride.

4. A composition according to claim 1, in which $R_2$ is selected from the group consisting of H, a hydrocarbyl radical having a molecular weight in the range of about 15 to about 2000, and a polyoxyalkylene radical of formula (III) wherein $R_3$ is H or a hydrocarbyl radical having 1–22 carbon atoms, Q, T, and Z are polyoxyalkylene moieties having 1–6 carbon atoms, a, b, c, and d have values ranging from 1–25, Y is O or $NR_5$, where $R_5$ is H or a hydrocarbyl radical having 1–22 carbon atoms, A is a straight chain or branched chain alkylene radical having 1–15 carbon atoms, m has a value in the range of 1–12, and n has a value in the range of 0–5.

5. A composition according to claim 1, in which the amino compound of formula (II) is selected from the group consisting of polyethylene polyamines, polypropylene polyamines and mixtures thereof.

6. A composition according to claim 1, in which the compatibilizing agent is an alcohol containing three or more carbon atoms.

7. A composition according to claim 1, in which the fuel conditioner component additionally comprises up to about 40 weight percent, based upon the total weight of the additive, of a hydrophilic separant.

8. A composition according to claim 1, in which the fuel conditioner component additionally comprises up to about 80 weight percent, based upon the total weight of the additive, of an aromatic hydrocarbon.

9. A composition according to claim 1, additionally comprising up to about 80 weight percent, based upon the total weight of the additive, of a carrier oil selected from the group consisting of petroleum-based oils, mineral oils, polypropylene compounds having a molecular weight in the range of about 500 to about 3000, polyisobutylene compounds having a molecular weight in the range of about 500 to about 3000, polyoxyalkylene compounds having a molecular weight in the range of about 500 to about 3000, and polybutyl and polyisobutyl alcohols containing polybutyl or polyisobutyl radicals derived from polyisobutene and up to 20% by weight of n-butene, corresponding carboxylates of the polybutyl or polyisobutyl alcohol, and mixtures thereof.

10. A method of preparing an effective octane reducing a motor fuel additive composition which reduces and modifies both, fuel intake system and combustion chamber deposit formation, the method consisting essentially of mixing:

(a) from about 5 to about 50 weight percent, based upon the total weight of the additive, of a detergent component selected from the group consisting of (i) a reckon product of:

(A) a substituted hydrocarbon of the formula $$R_1—X \quad (I)$$

wherein $R_1$ is a hydrocarbyl radical having a molecular weight in the range of about 150 to about 10,000, and X is selected from the group consisting of halogens, succinic anhydride and succinic dibasic acid, and (B) an amino compound of the formula $$H—(NH—(A)_m)_n—Y—R_2 \quad (II)$$

wherein Y is O or $NR_5$, $R_5$ being H or a hydrocarbyl radical having 1–30 carbon atoms; A is a straight chain or branched chain alkylene radical having 1–30 carbon atoms; m has a value in the range of 1–15; n has a value in the range of 0–6; and $R_2$ is selected from the group consisting of H, a hydrocarbyl radical having a molecular weight in the range of about 15 to about 10,000, and a homopolymeric or heteropolymeric polyoxyalkylene radical of the formula $$R_5—((Q)_a(T)_b(Z)_c)_d— \quad (III)$$

wherein $R_5$ is H or a hydrocarbyl radical having 1–30 carbon atoms, Q, T, and Z are polyoxyalkylene moieties having 1–6 carbon atoms, a, b and c each have values ranging from 0–30, and d has a value in the range of 1–50, and (ii) a polybutylamine or polyisobutylamine of the formula

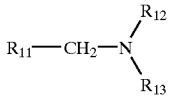

(IV)

where $R_{11}$ is a polybutyl or polyisobutyl radical derived from isobutene and up to 20% by weight of n-butene and $R_{12}$ and $R_{15}$ are identical or different and are each hydrogen, an aliphatic or aromatic hydrocarbon, a primary or secondary, aromatic or aliphatic aminoalkylene radical or polyaminoalkylene radical, a polyoxyalkylene radical or a heteroaryl or heterocyclyl radical, or, together with the nitrogen atom to which they are bonded, form a ring in which further hetero atoms may be present; and (b) a fuel conditioner component consisting essentially of:

(i) from about 2 to about 50 weight percent, based upon the total weight of the additive, of a polar oxygenated hydrocarbon having an average molecular weight in the range of about 200 to about 500, an acid number in the range of about 25 to about 175, and a saponification number in the range of about 30 to about 250, and (ii) from about 2 to about 50 weight percent, based upon the total of the additive, of an oxygenated compatibilizing agent having a solubility parameter in the range of about 7.0 to about 14.0 and moderate to strong hydrogen-bonding capacity.

11. A method according to claim 10, in which the mole ratio of the substituted hydrocarbon $R_1$—X to the amino compound is in the range of 0.2:1 to 20:1.

12. A method according to claim 10, in which $R_1$—X is a chloropolyisobutylene or a polyisobutenyl succinic anhydride.

13. A method according to claim 10, in which $R_2$ is selected from the group consisting of H, a hydrocarbyl radical having a molecular weight in the range of about 15 to about 2000, and a polyoxyalkylene radical of formula (III) wherein $R_3$ is H or a hydrocarbyl radical having 1–22 carbon atoms, Q, T, and Z are polyoxyalkylene moieties having 1–6 carbon atoms, a, b, c, and d have values ranging from about 1–25, Y is O or $NR_5$, wherein $R_5$ is H or a hydrocarbyl radical having 1–22 carbon atoms, A is a straight chain or branched chain alkylene radical having 1–15 carbon atoms, m has a value in the range of 1–12, and n has a value in the range of 0–5.

14. A method according to claim 10, in which the amino compound of formula (II) is selected from the group consisting of polyethylene polyamines, polypropylene polyamines and mixtures thereof.

15. A method according to claim 10, in which the compatibilizing agent is an alcohol containing three or more carbon atoms.

16. A method according to claim 10, in which the fuel conditioner component additionally comprises up to about 40 weight percent, based upon the total weight of the additive, of a hydrophilic separant.

17. A method according to claim 10, in which the fuel conditioner component additionally comprises up to about 80 weight percent, based upon the total weight of the additive, of an aromatic hydrocarbon.

18. A method according to claim 10, additionally comprising admixing the reaction product and fuel conditioner components with up to about 80 weight percent, based upon the total weight of the additive, of a carrier oil selected from the group consisting of petroleum-based oils, mineral oils, polypropylene compounds having a molecular weight in the range of about 500 to about 3000, polyisobutylene compounds having a molecular weight in the range of about 500 to about 3000, polyoxyalkylene compounds having a molecular weight in the range of about 500 to about 3000, and polybutyl and polyisobutyl alcohols containing polybutyl or polyisobutyl radicals derived from polyisobutene and up to 20% by weight of n-butane, corresponding carboxylates of the polybutyl or polyisobutyl alcohol, and mixtures thereof.

* * * * *